United States Patent [19]

Pyka

[11] Patent Number: 4,567,834

[45] Date of Patent: Feb. 4, 1986

[54] TILTED SHELF ASSEMBLY

[75] Inventor: Larry V. Pyka, Shawnee, Kans.

[73] Assignee: Hallmark Cards, Inc., Kansas City, Mich.

[21] Appl. No.: 496,841

[22] Filed: May 23, 1983

[51] Int. Cl.[4] ..... A47F 5/12

[52] U.S. Cl. ..... 108/1; 108/107; 108/109; 108/144

[58] Field of Search ..... 248/222.2, 235, 243; 211/167, 173, 174, 187; 108/1, 106, 107, 110, 144, 108, 109; 49/74; 16/261, 262, 386, 378, 379

[56] References Cited

U.S. PATENT DOCUMENTS

| | | | |
|---|---|---|---|
| 940,023 | 11/1909 | Hutchinson | 108/107 |
| 1,428,730 | 9/1922 | Weston | 108/1 |
| 1,876,172 | 9/1932 | Ruddy | 108/1 |
| 2,141,008 | 12/1938 | Meyer | 211/187 |
| 3,915,097 | 10/1975 | Young, Jr. | 211/187 |
| 4,223,966 | 9/1980 | Winters | 211/187 |
| 4,430,947 | 2/1984 | Kvame | 312/259 |
| 4,444,321 | 4/1984 | Carlstrom | 248/239 |

FOREIGN PATENT DOCUMENTS

| | | | |
|---|---|---|---|
| 103990 | 5/1938 | Australia | 211/148 |
| 284152 | 2/1964 | Canada | 49/74 |
| 2354730 | 6/1976 | France | 312/233 |

*Primary Examiner*—William E. Lyddane
*Assistant Examiner*—Joseph Falk
*Attorney, Agent, or Firm*—Neuman, Williams, Anderson & Olson

[57] ABSTRACT

A tilted shelf assembly is disclosed in which a shelf is in the form of a member of sheet material having bends including a 90 degree bend defining a junction between rearward and forward wall portions. The rearward wall portion is inserted between fingers of two brackets which have shaft portions engaged in openings in the side walls of a display fixture. A 180 degree bend is provided at the upper edge of the forward wall portion of the shelf, lockingly engaged between fingers of a forward pair of brackets.

7 Claims, 4 Drawing Figures

TILTED SHELF ASSEMBLY

This invention relates to a tilted shelf assembly and more particularly to a shelf assembly for installation in store display fixtures or the like. The shelf assembly of the invention is readily installed in existing fixtures, at a position which can be easily adjusted, and it operates to securely and reliably hold objects at positions for optimum display. The assembly is very simple in construction and operation and is economically manufacturable.

BACKGROUND OF THE INVENTION

Front-tilting shelving has been used in the type of glass fixtures which are common in department stores but the shelf assemblies have been cumbersome, complicated and inflexible. Typically, they have been very difficult to install and, once such shelves have been installed, it is very difficult if not impossible, from a practical stand-point, to adjust the position or angle and tilt of the shelves.

SUMMARY OF THE INVENTION

This invention was evolved with the general object of overcoming the problems of the prior art shelf assemblies and of providing a shelf assembly which can be easily installed in an existing display fixture or the like, and which also can be easily adjusted in position.

The invention is based in part upon the recognition of the problems with prior art devices and upon the recognition that such problems might be overcome by providing a shelf which might be inserted between vertical walls of a display fixture after installation of support brackets or other support means on the vertical walls. In a shelf assembly constructed in accordance with the invention, a shelf is arranged for installation after installation of rearward and forward support means on facing vertical wall surfaces. The shelf includes a rearward planar wall portion and a forward wall portion extending angularly upwardly from the forward edge of the rearward planar wall portion and it is insertable between facing vertical wall surfaces of a fixture to engage the rearward wall portion with the rearward support means. Means are provided on the upper edge of the forward wall portion to lockingly engage the forward support means after the rearward wall portion is engaged with the rearward support means.

This arrangement is advantageous in that the rearward and forward support means can be in place prior to installation of the shelf which can then be readily installed, first being engaged with the rearward support means and then being lockingly engaged with the forward support means. The arrangement is also advantageous in that it accommodates changes in the relative vertical positions of the forward and rearward support means, permitting adjustment of the angle of tilt of the shelf. In a typical case, the rearward wall portion extends angularly downwardly and forwardly and the forward wall portion extends angularly upwardly from the forward edge of the rearward wall portion, toward the front of the fixture which may typically be enclosed at the front, with a wall of glass or other transparent material. In this case, the shelf may be installed from the rear but it will be understood that if the fixture has an open front, the shelf can be just as easily installed from the front. It should also be understood terms such as "rearward" and "forward" are used for the purpose of identifying parts of the assembly and their relative orientation and are not otherwise to be construed as limitations.

In accordance with a specific feature of the invention, the rearward support means defines a slot into which the rearward edge of the rearward planar wall portion may be entered, after insertion of the shelf. Preferably, the rearward support means comprises a pair of brackets having spaced finger portions which receive the rearward planar wall portion therebetween, for secure support of the rearward wall portion. To facilitate assembly, the brackets are pivotal about a horizontal axis, preferably including projecting shaft portions which extend into holes of the vertical walls of a display fixture.

Further specific features of the invention relate to the construction of the holding means engageable with the forward support means. Preferably, the holding means is of generally inverted U-shaped cross-sectional configuration.

The shelf is in the form of a rectangular member of sheet material having bends which may, for example, be a member of transparent plastic material. A first bend is provided at a position parallel to and between the forward and rearward edges of the member and at an angle of on the order of 90 degrees. A second bend is provided which is on the order of 180 degrees to define the holding portion of inverted U-shaped cross-sectional configuration. The shelf is thus very simple in form and is readily manufactured. At the same time, it is such that it can be easily installed and adjusted in position, with the other advantages referred to above. The forward support means preferably may be in the form of a pair of brackets, most preferably being identical to the rearward brackets, for economy of manufacture and to assure proper assembly. The thickness of the shelf and the spacing between facing surfaces in the holding portion of inverted U-shaped configuration are preferably such as to obtain a secure and reliable support of the shelf while at the same time facilitating its installation in the display fixture.

This invention contemplates other objects, features and advantages which will become more fully apparent from the following detailed description taken in conjunction with the accompanying drawings.

DESCRIPTION OF A PREFERRED EMBODIMENT

Figure 1:
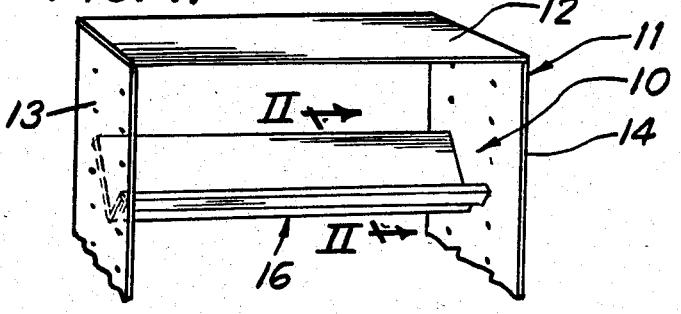
FIG. 1 is a perspective view showing an upper end portion of a store display fixture and a tilted shelf assembly mounted therein, according to the invention.
Figure 4:
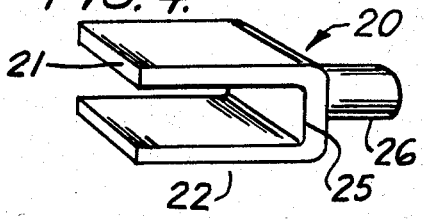
FIG. 4 is a perspective view of one of four brackets of the illustrated assembly.

Reference numeral 10 generally designates a tilted shelf assembly constructed in accordance with the principles of this invention, shown mounted in a store display fixture 11. The illustrated store fixture 11 includes a top 12 and side walls 13 and 14. The side walls 13 and 14 may be of glass and each of the side walls, as illustrated, has two series of holes drilled therein with predetermined regular vertical spacings between such holes, one series of holes being provided for support of a forward portion of the shelf assembly 10 and the other series being provided for support of a rearward portion of the shelf assembly 10. The fixture 11 may also include a closed front wall of glass or other transparent material as well as a rear wall which may be either transparent or opaque, and it will be understood that fixtures such as shown may be mounted in back-to-back relation.

The shelf assembly 10 includes a shelf 16 which includes a rearward planar wall portion 17 and a forward planar wall portion 18 extending angularly upwardly from the forward edge of the rearward wall portion 17. Preferably, the shelf 16 is in the form of a member of sheet material having bends therein including a 90 degree bend 19 at the junction between portions 17 and 18. The shelf 16 need not be formed by bending but may be cast in the illustrated shape.

Figure 2:
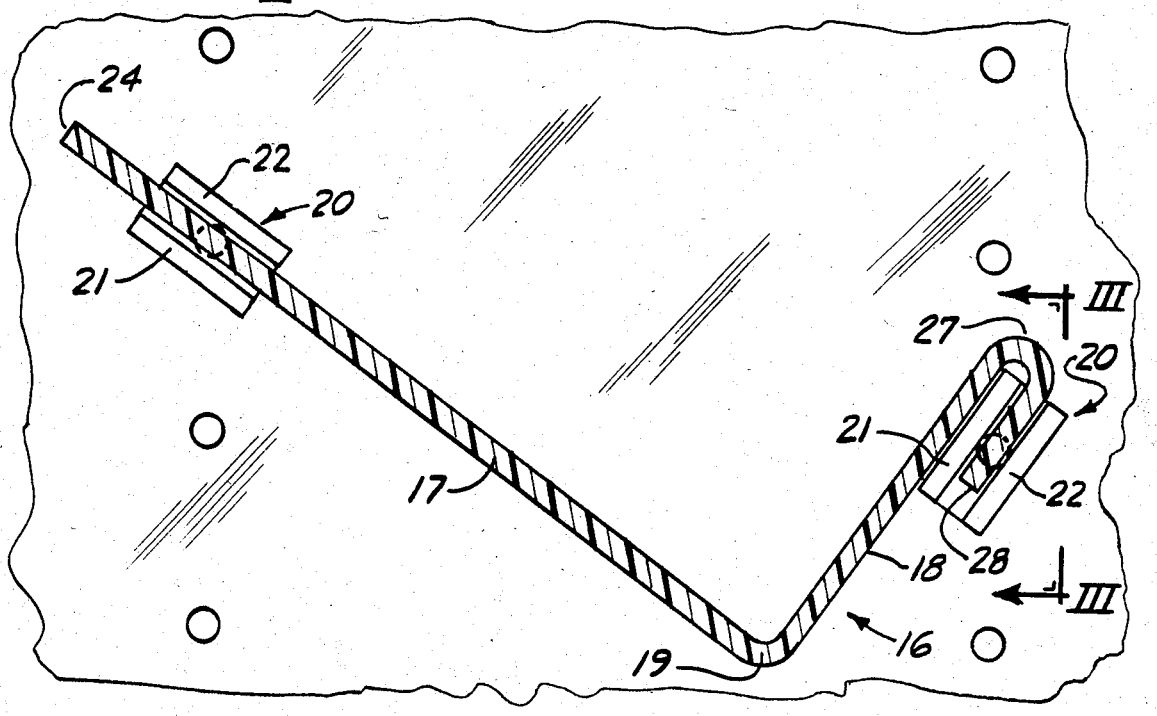
FIG. 2 is a sectional view taken substantially along line II—II of FIG. 1.
Figure 3:
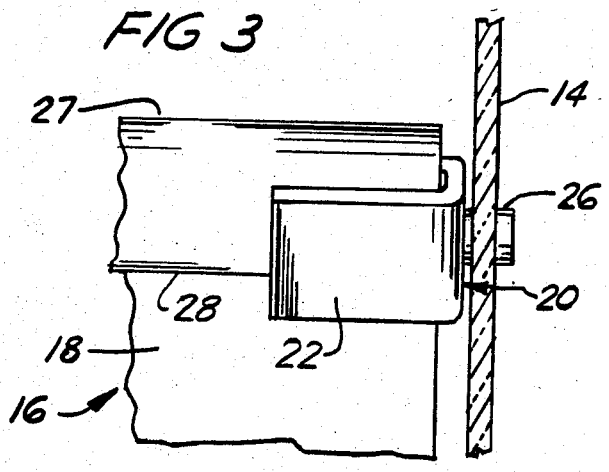
FIG. 3 is an elevational view of the structure shown in FIG. 2.

To support the rearward wall portion 17 from the fixture side walls 13 and 14, a pair of brackets 20 are provided, each of which may have substantially the same construction. As shown in FIGS. 2 and 3, the bracket 20 includes a pair of spaced finger portions 21 and 22 which define a slot. In installation of the shelf 16, the rearward edge of the planar wall portion, indicated by reference numeral 24, may be inserted into the slot between the finger portions 21 and 22. The bracket 20 also includes a portion 25 connecting the ends of the finger portions 21 and 22 and carrying a projecting shaft portion 26 which is inserted into one of the openings in the side wall 14.

To support the forward wall portion 18, holding means 27 are provided on the upper edge thereof, such holding means 27 being preferably of generally inverted U-shaped cross-sectional configuration and being in the form of a bend of on the order of 180 degrees, as shown. A portion 28 is thus provided in spaced relation to an upper part of the wall portion 18. The holding means 27 is supported by a pair of the brackets 20, identical to the brackets used for supporting the rearward wall portion 17. One of the finger portions 21 or 22 extends into the space between the portion 28 and the facing part of the forward wall portion 18.

With this very simple construction, the shelf 16 can be readily installed. First, the support brackets 20 are installed, the shaft portions 26 thereof being inserted into openings in the fixture walls 13 and 14. Then the shelf 16 is inserted between the walls 13 and 14, with the rearward edge 24 being first inserted into the slots defined by the spaced finger portions 21 and 22 of the rearward brackets 20. After engagement of the rearward wall portion 17 with the rearward brackets, the shelf 16 is moved to a position, as shown, with one of the fingers of each of the forward brackets 20 being positioned in the space between the portion 28 and the facing portion of the forward wall 18.

The finger portions 21 and 22 of the brackets 20 are preferably relatively wide, as shown, the spacing therebetween being a small fraction of the width thereof. This facilitates secure holding of the shelf 16. An important feature is that the shaft portions 26 provide pivotal connections which permit the required movements of the brackets necessary for ease of installation of the shelf 16. It is also noted that the width of the shelf 16 plus twice the thickness of each of the connecting portions 25 of the brackets is less than the spacing between the vertical facing surfaces of the walls 13 and 14 so as to facilitate installation of the shelf 16 while being large enough to cause the shelf to be securely held in position.

Another feature of the construction is that the angle of tilt of each shelf may be readily adjusted, simply by using a different pair of holes for supporting the forward or rearward wall portion of the shelf 16.

Although other materials may be used, the shelf 16 is preferably of a transparent plastic material such as, for example, a 3/16 inch thick continuous cast clear acrylic material. The brackets 20 may also be of a clear plastic material and with the side walls 13 and 14 of the fixture being of a glass or other transparent material, a very attractive display fixture is provided. At the same time, the shelves may be readily installed and the position thereof may be easily adjusted from time to time in using the fixture for displaying various types of objects.

It will be understood that modifications and variations may be effected without departing from the spirit and scope of the novel concepts of this invention.

I claim:

1. A shelf assembly for installation between facing planar vertical surfaces of horizontally spaced vertical walls of a display fixture or the like, said shelf assembly comprising: a shelf, and forward and rearward support means, each of said support means comprising a pair of brackets having shelf support portions and having projecting shaft portions for extending into mounting holes in said facing planar vertical surfaces of said vertical walls so as to be adapted to be installed on said facing vertical wall surfaces prior to installation of said shelf and to position said shelf support portions of said brackets in inwardly projecting relation to said facing planar vertical surfaces, said shelf including a rearward planar wall portion and a forward wall portion extending angularly upwardly from the forward edge of said rearward planar wall portion, said shelf being insertable between said facing planar vertical wall surfaces to engage opposite ends of said rearward planar wall portion with said inwardly projecting shelf support portions of said pair of brackets of said rearward support means, said inwardly projecting shelf support portions of said pair of brackets of said rearward support means defining slot means arranged for entry therein of the opposite ends of the rearward edge of said rearward planar wall portion after insertion of said shelf between said facing vertical surfaces and for adjustable slidable movement of said shelf after entry therein of said opposite ends of said rearward edge, said projecting shaft portions of said pair of brackets of said rearward support means defining pivot means to permit pivotal movement of said rearward support means about a horizontal axis, and said shelf including down-turned holding means on opposite ends of the upper edge of said forward wall portion thereof for locking engagement with said inwardly projecting shelf support portions of said pair of brackets of said forward support means after engagement of said opposite ends of said rearward planar wall portion with said inwardly projecting shelf support portions of said rearward support means, said slot means and said pivot means of said pair of brackets of said rearward support means being cooperable to obtain a relatively slidable and pivotal relationship to facilitate installation of said shelf and adjustment of the angle of said shelf by selection of the relative vertical positions of mounting holes for said forward and rearward pairs of brackets, and said forward pair of brackets being cooperable with said down-turned holding means to prevent forward and rearward movement of said shelf after installation at a selected angular position.

2. In a shelf assembly as defined in claim 1, said down-turned holding means being part of a holding portion of generally inverted U-shaped cross-sectional configuration arranged to embrace said inwardly projecting shelf support portions of said pair of brackets of said forward support means to limit forward and rearward displacement of said shelf.

3. In a shelf assembly as defined in claim 2, said shelf being formed of a rectangular member of sheet material having a first bend parallel to and between forward and rearward edges and at an angle of on the order of 90 degrees to provide said forward planar wall portion and said rearward angularly extending wall portion, and said member having a second bend of on the order of 180 degrees to define said holding portion of generally inverted U-shaped cross-sectional configuration.

4. In a shelf assembly as defined in claim 2, said shelf being of a transparent plastic material.

5. In a shelf assembly as defined in claim 3, said inwardly projecting shelf support portions of each of said pair of brackets of said forward support means including a pair of spaced finger portions defining slot means arranged for entry therein of the opposite ends of one part of said holding portion of generally inverted U-shaped cross-sectional configuration.

6. In a shelf assembly as defined in claim 5, said inwardly projecting shelf support portions of each of said pair of brackets of said rearward support means including a pair of spaced finger portions defining said slot means.

7. In a shelf assembly as defined in claim 6, said finger portions of each of said brackets being wide with the spacing therebetween being a small fraction of the width thereof and being at most only slightly greater than the thickness of said member of sheet material from which said shelf is formed.

* * * * *